US006007409A

United States Patent [19]

Chung

[11] Patent Number: 6,007,409

[45] Date of Patent: Dec. 28, 1999

[54] SAMPLE HOLDER FOR PARALLEL LAPPING TOOL AND METHOD OF USING

[75] Inventor: Lee Chung, Hsin-Chu, Taiwan

[73] Assignee: Taiwan Semiconductor Manufacturing Company, Ltd., Hsin-Chu, Taiwan

[21] Appl. No.: 09/057,266

[22] Filed: Apr. 8, 1998

[51] Int. Cl.[6] ..... B24B 37/04

[52] U.S. Cl. ..... 451/41; 451/405

[58] Field of Search ..... 451/41, 364, 380, 451/387, 386, 391, 405

[56] References Cited

U.S. PATENT DOCUMENTS

| | | | |
|---|---|---|---|
| 2,830,412 | 4/1958 | Shurson | 451/364 X |
| 3,867,797 | 2/1975 | Meier | 451/405 X |
| 3,868,794 | 3/1975 | Zitkus | 451/405 X |
| 4,707,948 | 11/1987 | Schindler et al. | 451/364 |

*Primary Examiner*—Robert A. Rose
*Assistant Examiner*—Anthony Ojini
*Attorney, Agent, or Firm*—Tung & Associates

[57] ABSTRACT

The present invention discloses a sample holder for a miniature device for use in a parallel lapping tool that is equipped with a hollow-centered sample holder assembly such that the condition of the sample being prepared can be continuously monitored from either the top side or the bottom side of the holder, and at least three adjusting screws that are used to adjust a plane of lapping to be the same as the plane of interest in said miniature device to be observed such that once the plane is obtained, only the sample displacement knob situated at the center of the holder needs to be adjusted to further advance the sample for removal of more material.

20 Claims, 3 Drawing Sheets

SAMPLE HOLDER FOR PARALLEL LAPPING TOOL AND METHOD OF USING

FIELD OF THE INVENTION

The present invention generally relates to a sample holder for a miniature device and a method for using such holder in a parallel lapping tool and more particularly, relates to a sample holder for an integrated circuit device that is equipped with a hollow-centered sample holder assembly and at least three adjusting screws such that the IC device may be observed during the lapping process and the planarity of the device surface needs to be adjusted only once before the lapping process and a method for using such sample holder.

BACKGROUND OF THE INVENTION

In the fabrication process for integrated circuit (IC) devices, methods of microscopic examination are frequently used for quality control purpose and for examination of defects. For instance, either an optical microscope at high magnification or a transmission electron microscope can be used to examine features in an IC device for process verification and quality assurance. The microscopes can be used to examine passivation layers and via formation between metal conductor layers, and defects in polygate formation.

To prepare samples of IC devices for microscopic examination, an extremely smooth surface on the sample must first be prepared. Conventionally, a lapping or polishing apparatus is utilized for preparing such samples for microscopic examination. In a lapping tool, a lapping or polishing wheel having an abrasive surface such as a diamond abrasive paper is used to remove surface layers on an IC device. In order to insure an accurate and even removal of the surface layers, the IC device must be securely held in a sample holder. Conventionally, numerous commercially available sample holders are used for such purpose.

One of such commercially available sample holder is shown in FIG. 1A. In the parallel lapper 10, a micronmeter 12 is used to advance a die such that surface layers of minute thickness on the die 20 can be removed. The die 20 is shown in FIG. 1B. A die holder 16, which is a liquid filled diaphragm is used to hold the die 20 for attaching to a disc (not shown) in the lapping tool 10. The parallel lapper 10 can be held by hand and pressed upon a grinding wheel, or a polishing disc 22. A typical polishing or lapping disc used is a diamond abrasive paper. In the lapping tool 10 shown in FIGS. 1A and 1B, while the thickness of the surface layer of the die 20 removed can be controlled by the micronmeter 12, the planarity of the new surface on the die 20 cannot be accurately controlled. In other words, a larger thickness may be removed from one edge of the die than the other edge of the die. This causes great processing difficulties in preserving a specific feature or a defect in the die surface that is to be examined.

An improved parallel lapper 30 is shown in FIG. 2. In parallel lapper 30, three equally spaced micronmeters 32 are mounted in a sample holder disc 26 while an IC die is held by a sample mount 28. The parallel lapper 30 provides the benefit of improved control of the planarity of the sample surface to be polished. By suitably adjusting the three micronmeters 32, an accurate thickness of the sample surface can be removed. However, each time an additional layer on the die surface is to be removed, all three micronmeters 32 must be simultaneously adjusted. The adjustment presents a laborious task in using the parallel lapper 30 for preparing a sample surface on an IC die. Moreover, in order to determine whether a desirable surface has been obtained, i.e., the surface which contains the defect to be examined, the IC die held on the sample mount 28 must be examined in an inverted microscope to make such determination. The condition of the IC die cannot be observed from the top of the parallel lapper 30.

It is therefore an object of the present invention to provide a sample holder for a miniature device for use in a parallel lapping tool that does not have the drawbacks and shortcomings of the conventional sample holders.

It is another object of the present invention to provide a sample holder for an electronic device for use in a parallel lapping tool that is equipped with a hollow-centered sample holder assembly such that the condition of the sample surface and the lapping process can be readily monitored from the top of the sample holder assembly.

It is a further object of the present invention to provide a sample holder for an IC device for use in a parallel lapping tool that is equipped with a hollow-centered sample holder assembly and at least three adjusting screws equally spaced circumferentially from each other and radially from the center of the holder such that a plane of polish can be adjusted to parallel a plane of interest in the IC device.

It is another further object of the present invention to provide a sample holder for an IC device for use in a parallel lapping tool that is equipped with a hollow-centered sample holder assembly threadingly engaging the sample holder body such that, after a plane of polish is adjusted to parallel a plane of interest, the thickness of the layer removed from the sample surface can be readily adjusted by advancing the sample holder assembly.

It is still another object of the present invention to provide a sample holder for an IC device for use in a parallel lapping tool that has a sample holder body of disc shape, a threaded center aperture and at least three threaded apertures situated equally spaced circumferentially from each other and radially from the center aperture.

It is yet another object of the present invention to provide a sample holder for an IC device for use in a parallel lapping process which is equipped with a hollow-centered sample holder assembly and a sample mounting knob equipped with a substantially clear window for mounting the IC device thereto.

It is still another further object of the present invention to provide a method for mounting an electronic device to a sample holder for use in a parallel lapping tool by providing a hollow-centered sample holder assembly mounted in a sample holder body for adjusting the thickness of the sample surface to be removed and at least three adjusting screws for adjusting a plane of polish to be parallel with a plane of interest in the electronic device and then mounting the electronic device to the hollow-centered sample holder assembly.

It is yet another further object of the present invention to provide a method for parallel lapping an integrated circuit device by first providing a hollow-centered sample holder assembly mounted in a sample holder body for adjusting the thickness of surface layer to be removed and at least three adjusting screws for adjusting a plane of polish to a plane of interest and then lapping an IC device mounted to the sample holder assembly in a parallel lapping tool while observing the progress of lapping through the hollow-centered holder assembly.

SUMMARY OF THE INVENTION

In accordance with the present invention, a sample holder for a miniature device for use in a parallel lapping tool and a method for using the sample holder are disclosed.

In a preferred embodiment, a sample holder for a miniature device for use in a parallel lapping tool is provided which includes a sample holder body of disc shape having a threaded center aperture and at least three threaded apertures situated equally spaced circumferentially from each other and radially from the center aperture, a hollow-centered sample holder assembly that has threads on its outer periphery and a bottom surface substantially parallel to a bottom surface of the sample holder body when mounted in the body adapted for mounting a miniature device thereto such that a bottom surface of the device is exposed for lapping, and at least three adjusting screws for threadingly engaging the at least three threaded apertures adapted for adjusting a plane of lapping to be substantially the same as a plane of interest to be observed in a microscopic examination process. The sample holder may further include a sample displacement knob, a sample mounting knob, a sample compression knob, a sample mounting knob retainer, and a compressible spring mounted between the sample compression knob and the sample mounting knob, wherein all the knobs and the retainer are hollow-centered. The sample mounting knob may further include a substantially clear window for mounting the miniature device thereto. Each of the at least three adjusting screws is equipped with a tip portion made of a low friction material. A suitable low friction material may be Teflon®. Each of the at least three adjusting screws may also include a head portion having vertical grooves such that a preset distance between the grooves corresponds to a predetermined vertical displacement of the adjusting screws when the head portion is turned to advance the screws. The adjusting screws may further include means for monitoring the number of grooves that has been turned. The sample displacement knob may be equipped with a similar head portion with vertical grooves such that the advancement of the miniature device mounted on the sample mounting knob can be accurately monitored.

The present invention is also directed to a method for mounting an electronic device to a sample holder used in a parallel lapping tool that can be carried out by the operating steps of first providing a sample holder body of disc shape that has a threaded center aperture and at least three threaded apertures situated equally spaced circumferentially from each other and radially from the center aperture, then providing a hollow-centered sample holder assembly that has threads on its outer periphery for engaging the threaded center aperture and a bottom surface substantially parallel to a bottom surface of the sample holder body when mounted in the body adapted for mounting an electronic device thereto such that a bottom surface of the device is exposed for lapping, then providing at least three adjusting screws for threadingly engaging the at least three threaded apertures, then adjusting a plane of lapping to be substantially the same as a plane of interest to be examined in a microscopic examination process, and mounting an electronic device to the hollow-centered sample holder assembly.

The method for mounting an electronic device may further include the steps of providing a sample displacement knob, a sample mounting knob, a sample compression knob, a sample mounting knob retainer, and a compressible spring mounted between the sample compression knob and the sample mounting knob, wherein all the knobs and the retainer are hollow-centered. The method may further include the step of equipping the sample mounting knob with a substantially clear window for mounting the electronic device thereto. The method may further include the step of mounting the electronic device to the substantially clear window and observing the device through the hollow-centered knobs and retainer, and the substantially clear window. The method may further include the step of equipping the tip portion of each of the at least three adjusting screws with a low friction material, and equipping a head portion of the at least three adjusting screws and the sample displacement knob with means adapted for measuring vertical displacement of the screws and the knob when the screws and knob are manually turned to advanced the screws and the knob.

The present invention is further directed to a method for parallelly lapping an integrated circuit device that can be carried out by the operating steps of first providing a sample holder body of disc shape that has a threaded center aperture and at least three threaded apertures equally spaced circumferentially from each other and radially from the center aperture, then providing a hollow-centered sample holder assembly that has threads on its outer periphery and a bottom surface substantially parallel to a bottom surface of the sample holder body when mounted in the body adapted for mounting the IC device thereto such that a bottom surface of the device is exposed for lapping, then providing at least three adjusting screws for threadingly engaging the at least three threaded apertures, then adjusting a plane of lapping to be substantially the same as a plane of interest to be examined in a microscopic examination process, then mounting the IC device to the hollow-centered sample holder assembly, lapping the IC device in a parallel lapping tool, and observing progress of the lapping process through the hollow-centered sample holder assembly.

The method may include the step of providing a hollow-centered sample mounting knob that is equipped with an optically clear window for mounting the IC device thereto in the hollow-centered sample holder assembly. The method may further include the step of, after observing the progress of the lapping process, advancing the hollow-centered sample holder assembly to further advance the surface of the IC device to a lapping medium. The method may also include the steps of providing a sample displacement knob, a sample mounting knob, a sample compression knob, a sample mounting knob retainer, and a compressible spring mounted between the sample compression knob and the sample mounting knob, wherein the knobs and the retainer are hollow-centered. The method may further include the step of equipping a head portion of the at least three adjusting screws and the sample displacement knob with means adapted for measuring vertical displacement of the screws and the knob when they are manually turned for advancement of the IC device.

BRIEF DESCRIPTION OF THE DRAWINGS

The objects, features and advantages of the present invention will become apparent from the following detailed description and the appended drawings in which.

DETAILED DESCRIPTION OF THE PREFERRED EMBODIMENT

The present invention discloses a sample holder for a miniature device for use in a parallel lapping tool and a method for utilizing such holder. While the present invention sample holder is particularly suitable for holding an integrated circuit die for lapping in a parallel lapping process, its application is not limited to such integrated circuit die and it can be used for holding any other miniature devices. The novel sample holder is constructed of a sample holder body of disc shape for holding a hollow-centered sample holder assembly which can be used to advance independently the surface of the object to be polished, and three adjusting screws that are capable of adjusting a plane of polishing to be substantially the same as a plane of interest to be observed in a later microscopic examination process. The present invention novel holder provides several advantageous features. First, the plane of polish or lapping can be independently adjusted such that a plane of interest,( i.e., which contains a special feature or a defect) to be later observed can be easily obtained. Secondly, the planarity of the sample holder can be kept constant by simply advancing a sample holder knob when a larger thickness of the sample surface needs to be removed. Thirdly, the hollow-center in the sample holder assembly and the clear window on the sample holder knob enable the observation of the sample from the top of the sample holder such that the condition of sample preparation may be readily monitored from either the bottom side or the top side of the sample holder in a microscope.

The present invention novel holder can be used to accurately prepare samples for optical microscope or transmission electron microscope in predetermined, micron-sized specimen regions. When preparing samples for use in transmission electron microscope, the present invention novel holder can be used to either prepare samples directly for observation in the microscope or, to prepare samples for further ion milling process and thus greatly reduces the required processing time in ion milling. Although the novel apparatus is particularly suitable for preparing plane areas in semiconductor dies for observation, it can also be used in preparing both plane-view and cross-sectional view of samples of various other materials such as ceramics, metals and composites.

Figure 1A:
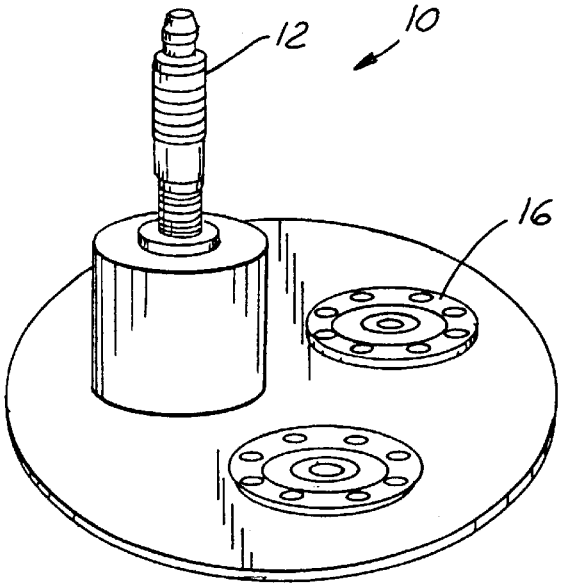
(PRIOR ART) FIG. 1A
FIG. 1A is a perspective view of a conventional sample holder for a parallel lapping tool.
Figure 1B:
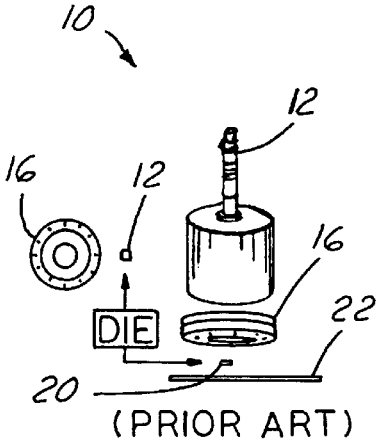
(PRIOR ART) FIG. 1B
FIG. 1B is a perspective view of a conventional sample holder including a diaphragm type die holder and a grinding wheel.
Figure 2:
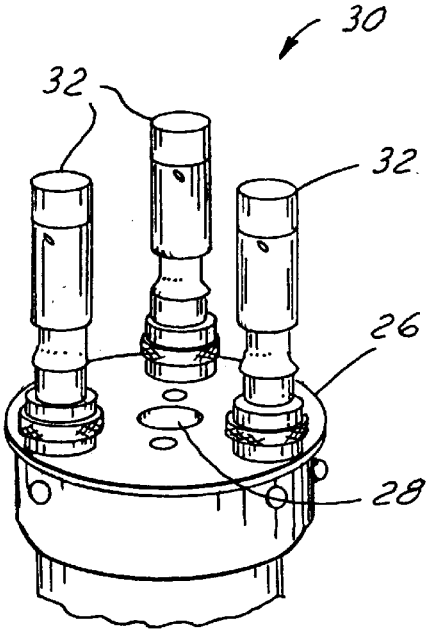
(PRIOR ART) FIG. 2
FIG. 2 is a perspective view of an improved conventional sample holder equipped with three micronmeters for adjusting the plane of lapping.
Figure 3A:
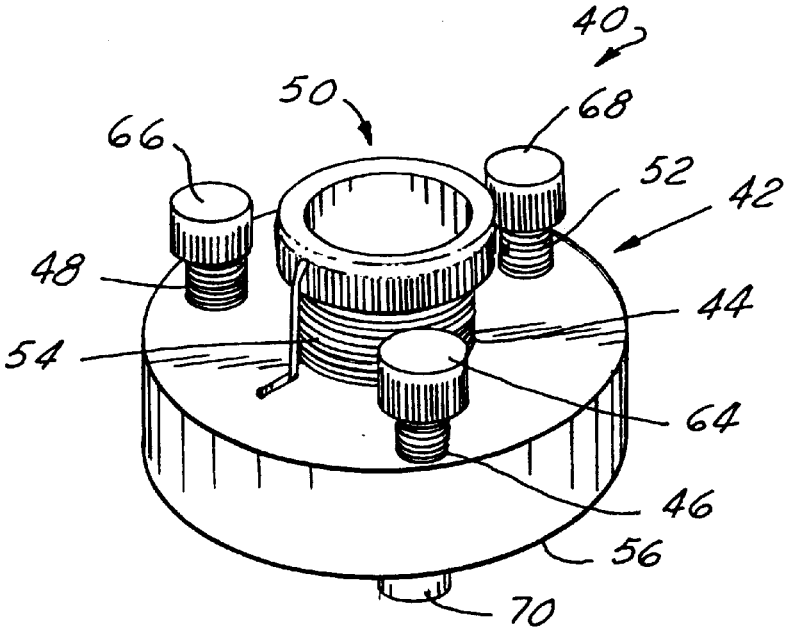
FIG. 3A is a perspective view of the present invention sample holder for a parallel lapping tool viewed from the top.

Referring initially to FIG. 3A wherein a present invention sample holder 40 is shown in a perspective view. The sample holder 40 is constructed of a sample holder body 42 of disc shape which has a threaded center aperture 44 and three threaded apertures 46, 48 and 52 that are equally spaced circumferentially from each other and radially from the center aperture 44. The sample holder 40 further includes a hollow-centered sample holder assembly 50 that has threads 54 on its outer periphery and a bottom surface (not shown) which is substantially parallel to a bottom surface 56 of the sample holder body 42 when the two parts are mounted together.

Figure 3B:
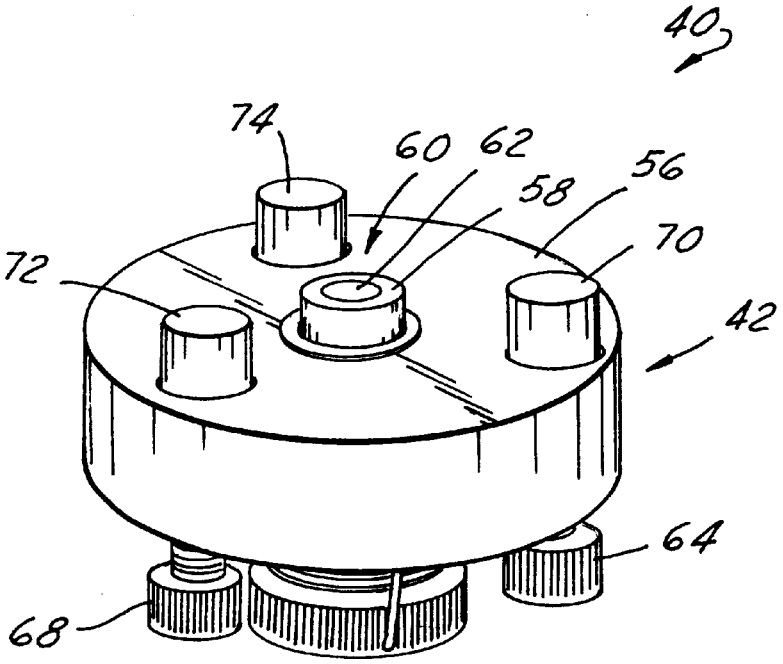
FIG. 3B is a perspective view of the present invention sample holder for a parallel lapping tool viewed from the bottom.

In a bottom view of the sample holder 40 shown in FIG. 3B, the bottom surface 58 of the sample holder knob 60 is shown. The bottom surface 58 of the sample holder knob 60 is normally equipped with a substantially clear window 62 for mounting an IC device (not shown) thereto. It should be noted that the sample holder knob 60 is hollow-centered such that the condition of the IC die can be readily examined from the top of the holder 40. The bottoms of the adjusting screws 64, 66 and 68, shown in FIG. 3B are equipped with sleeves made of a low friction material. For instance, the sleeves 70, 72 and 74 may be advantageously made of Teflon®. Other low friction materials such as silicon carbide may also be used to cover the tips of the adjusting screws. It should be noted that the tip of the screws is expensible and as such, it is replaced after a predetermined number of hours of polishing.

In a typical lapping process, the sample holder shown in FIGS. 3A and 3B can be used to prepare a specimen for either an optical microscopic or a transmission electron microscopic observation. An IC die can be mounted to the window 62 (FIG. 3B) by a double-sided adhesive tape or a liquid adhesive that is substantially transparent. After the lapping process is completed, the sample can be removed by dissolving the adhesive with a suitable solvent such as acetone. In a typical lapping process, the initial lapping is conducted on a 15 $\mu$m metal bonded diamond disc, followed by further lapping and polishing with a succession of diamond films ranging in size from 30 $\mu$m to 0.5 $\mu$m. A final lapping process can be carried out with a colloidal silica material.

Figure 3C:
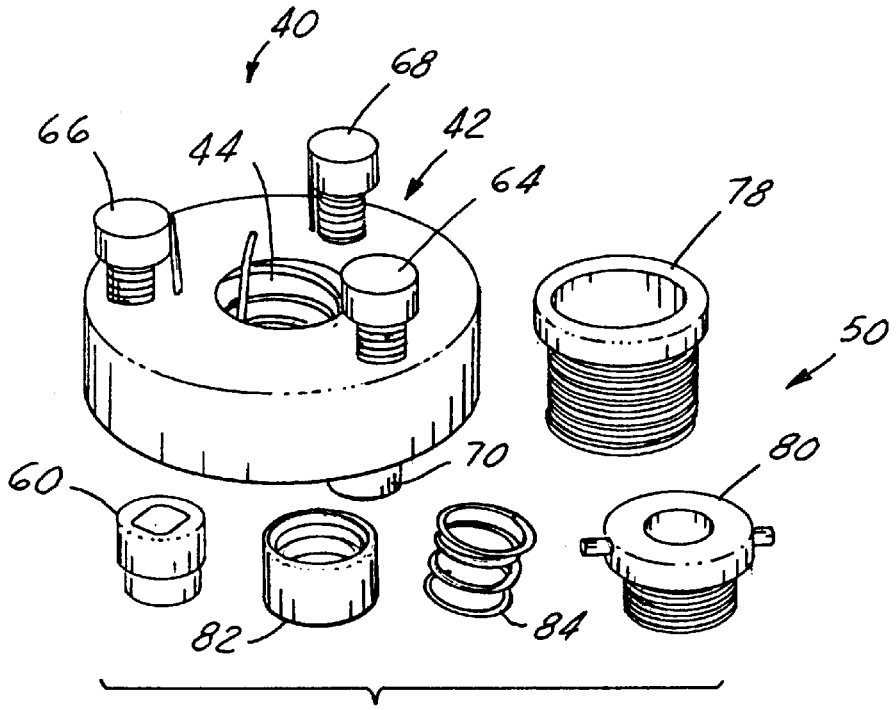
FIG. 3C is a perspective view of the present invention sample holder for a parallel lapping tool showing the components of the holder.
Figure 3D:
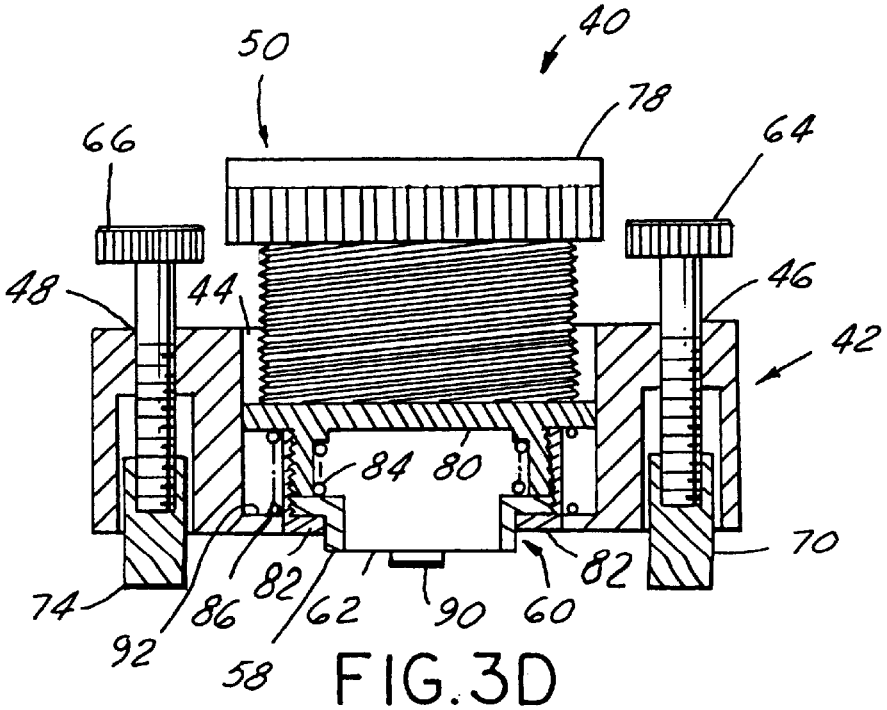
FIG. 3D is a cross-sectional view of the present invention sample holder for a parallel lapping tool.

The components of the present invention sample holder 40 are shown in FIG. 3C and 3D. A perspective view of the components is shown in FIG. 3C, while a cross-sectional view of the components in an assembled position is shown in FIG. 3D. The hollow-centered sample holder assembly 50 is disassembled into five major components, a sample displacement knob 78, a compression knob 80, a sample mounting knob 60, a sample mounting knob retainer 82, and a compressible spring 84. These components are also shown in FIG. 3D in a cross-sectional view in an assembled position. It should be noted that a second compressible spring 86 which is mounted between the sample compression knob 80 and the threaded center aperture 44 is not shown in the view of FIG. 3C. As shown in FIG. 3D, an IC die 90 is glued to the clear window 62 of the sample mounting knob 60.

In utilizing the present invention sample holder 40 in a parallel lapping process, the hollow-centered sample holder assembly 50 is first assembled together into the center aperture 44 of the holder body 42. This is accomplished by first engaging the sample holder knob 60 into the hollow-center of the retainer 82 such that the holder 60 sits securely on a bottom ledge of the retainer 82. The retainer 82 is then assembled to the compression knob 80 by thread engagement with a compressible spring 84 situated thereinbetween. The assembly of the compression knob/mounting knob/retainer is then placed in the center aperture 44 with the compressible spring 86 positioned between the compression knob 80 and the bottom surface 92 of the aperture 44. The function of the compressible spring 86 is important since it provides an adjustment of pressure on the IC die 90 during a lapping process. The sample displacement knob 78 is then screwed into the threaded aperture 44 until it is stopped by the top surface of the compression knob 80.

To complete the sample holder assembly process, the three adjusting screws 64, 66 and 68 each has a Teflon® sleeve 70, 72 and 74 installed at its tip are threaded into the three threaded apertures 46, 48 and 52.

During a lapping process, the three adjusting screws 64, 66 and 68 are advanced or withdrawn in a trial and error manner until a plane of polish that is substantially parallel to the plane of interest (which contains the feature or defect to be observed) is achieved. One of the major benefits achieved by the present invention novel sample holder is that the screws 64, 66 and 68 need only be adjusted once to achieve the desirable planarity, i.e., parallel to the plane in the surface of the IC die that contains the feature or defect to be observed. As the lapping process progresses, if a thicker layer on the surface of the IC die 90 needs to be removed, only the sample displacement knob 78 needs to be adjusted by turning it clockwise to further push the sample holder 60, and the IC die 90 outwardly away from the sample holder body 42. The novel feature is only made possible by the present invention apparatus which is contrary to that required in a conventional apparatus, i.e., each time when a thicker layer of material needs to be removed, all three micronmeters must be advanced by an equal amount. Such adjustment is difficult to carry out since any inaccuracy in adjusting the three micronmeters would change the plane of polish and thus missing the feature to be observed after polishing.

Another major benefit that is made possible by the present invention novel apparatus is the ability to observe a thin specimen through the hollow-center of the sample holder assembly 50. This is important since the condition of the IC die 90 can be maintained not only in an inverted microscope from the bottom side, it can also be maintained in a regular microscope from the top side. This provides a great processing advantage of easy observation and monitoring of the lapping process.

The present invention novel sample holder for a miniature device for use in a parallel lapping tool and a method for using such holder have been amply demonstrated by the above descriptions and the appended drawings of FIGS. 3A~3D. It should be emphasized that, even though the preparation of an IC die is used as a sample of the present invention novel apparatus, the apparatus can be utilized for preparing any other samples for observation in an optical microscope or in a transmission electron microscope.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

I claim:

1. A sample holder for a miniature device for use in a parallel lapping tool comprising:

a sample holder body of disc shape having a threaded center aperture and at least three threaded apertures situated equally spaced circumferentially from each other and radially from said center aperture, a hollow-centered sample holder assembly having threads on its outer periphery and a bottom surface substantially parallel to a bottom surface of said sample holder body when mounted in said body adapted for receiving a miniative device thereon such that a bottom surface of the device is exposed for lapping, and at least three adjusting screws for threadingly engaging said at least three threaded apertures adapted for adjusting a plane of lapping to be substantially the same as a plane of interest in said miniature device to be examined.

2. A sample holder for a miniature device according to claim 1, wherein said hollow-centered sample holder assembly further comprising:

a sample displacement knob, a sample mounting knob, a sample compression knob, a sample mounting knob retainer, and a compressible spring mounted between said sample compression knob and said mounting knob, wherein all the knobs and the retainer are hollow-centered.

3. A sample holder for a miniature device according to claim 1, wherein said hollow-centered sample holder further comprising a sample mounting knob equipped with a substantially clear window for mounting said miniature device thereon.

4. A sample holder for a miniature device according to claim 1, wherein each of said at least three adjusting screws is equipped with a tip portion made of a low friction material.

5. A sample holder for a miniature device according to claim 1, wherein each of said at least three adjusting screws is equipped with a tip portion made of Teflon®.

6. A sample holder for a miniature device according to claim 1, wherein each of said at least three adjusting screws is further equipped with a head portion having vertical grooves wherein a preset distance between said grooves corresponds to a predetermined vertical displacement of said adjusting screws when said head portion is turned to advance the screws.

7. A sample holder for a miniature device according to claim 1 further comprising means for monitoring the number of grooves that has been turned.

8. A sample holder for a miniature device according to claim 1, wherein said sample displacement knob is equipped with a head portion having vertical grooves wherein a preset distance between said grooves corresponds to a predetermined vertical displacement of said sample displacement knob when said head portion is turned to advance the displacement knob and consequently to advance the miniature device mounted on the sample mounting knob.

9. A method for mounting an electronic device to a sample holder used in a parallel lapping tool comprising the steps of:

providing a sample holder body of disc shape having a threaded center aperture and at least three threaded apertures situated equally spaced circumferentially from each other and radially from said center aperture, providing a hollow-centered sample holder assembly having threads on its outer periphery and a bottom surface substantially parallel to a bottom surface of said sample holder body when mounted in said body adapted for receiving said electronic device thereon such that a bottom surface of the device is exposed for lapping, providing at least three adjusting screws for threadingly engaging said at least three threaded apertures, adjusting a plane of lapping to be substantially the same as a plane of interest in said electronic device to be examined in a microscope, and mounting said electronic device to said hollow-centered sample holder assembly.

10. A method for mounting an electronic device to a sample holder assembly according to claim 9 further comprising the steps of:

providing a sample displacement knob, providing a sample mounting knob, providing a sample compression knob, providing a sample mounting knob retainer, and providing a compressible spring mounted between said sample compression knob and said mounting knob, wherein the knobs and the retainer are hollow-centered.

11. A method for mounting an electronic device to a sample holder assembly according to claim 10 further comprising the step of equipping a head portion on said at least three adjusting screws and said sample displacement knob with means adapted for measuring vertical displacement of said screws and said knob when said screws and knob are manually turned to advance the screws and the knob.

12. A method for mounting an electronic device to a sample holder assembly according to claim 9 further comprising the step of equipping said sample mounting knob with a substantially clear window for mounting said electronic device thereto.

13. A method for mounting an electronic device to a sample holder assembly according to claim 9 further comprising the step of adhering said electronic device to said substantially clear window.

14. A method for mounting an electronic device to a sample holder assembly according to claim 13 further comprising the step of observing said electronic device through said hollow-centered knobs and retainer, and said substantially clear window.

15. A method for mounting an electronic device to a sample holder assembly according to claim 9 further comprising the step of equipping a tip portion on each of said at least three adjusting screws with a low friction material.

16. A method for parallelly lapping an integrated circuit (IC) device comprising the steps of:

providing a sample holder body of disc shape having a threaded center aperture and at least three threaded apertures situated equally spaced circumferentially from each other and radially from said center aperture, providing a hollow-centered sample holder assembly having threads on its outer periphery and a bottom surface substantially parallel to a bottom surface of said sample holder body when mounted in said body adapted for receiving said IC device thereon such that a bottom surface of the device is exposed for lapping, providing at least three adjusting screws for threadingly engaging said at least three threaded apertures, adjusting a plane of lapping to be substantially the same as a plane of interest in said IC device to be examined in a microscope examination process, mounting said IC device to said hollow-centered sample holder assembly, and lapping said IC device in a parallel lapping tool while observing progress of lapping through said hollow-centered sample holder assembly.

17. A method for parallelly lapping an IC device according to claim 16 further comprising the step of providing a hollow-centered sample mounting knob equipped with an optically clear window for mounting said IC device thereto in said hollow-centered sample holder assembly.

18. A method for parallelly lapping an IC device according to claim 16 further comprising the step of after observing the progress of the lapping process, advancing the hollow-centered sample holder assembly to further advance the surface of the IC device to a lapping medium.

19. A method for parallelly lapping an IC device according to claim 16 further comprising the steps of:

providing a sample displacement knob, providing a sample mounting knob, providing a sample compression knob, providing a sample mounting knob retainer, and providing a compressible spring mounted between said sample compression knob and said mounting knob, wherein the knobs and the retainer are hollow-centered.

20. A method of parallelly lapping an IC device according to claim 16 further comprising the steps of equipping a head portion on said at least three adjusting screws and said sample displacement knob with means adapted for measuring vertical displacement of said screws and said knob when said screws and knob are manually turned to advance the screws and the knob.

* * * * *